US011180942B1

(12) United States Patent
Lawrence

(10) Patent No.: US 11,180,942 B1
(45) Date of Patent: Nov. 23, 2021

(54) REMOVABLE WINDOW VENT STOP

(71) Applicant: Barry G. Lawrence, Trinity, NC (US)

(72) Inventor: Barry G. Lawrence, Trinity, NC (US)

( * ) Notice: Subject to any disclaimer, the term of this patent is extended or adjusted under 35 U.S.C. 154(b) by 137 days.

(21) Appl. No.: 16/684,688

(22) Filed: Nov. 15, 2019

(51) Int. Cl.
*E05F 5/00* (2017.01)
*E06B 3/44* (2006.01)

(52) U.S. Cl.
CPC ..... *E05F 5/003* (2013.01); *E06B 3/4415* (2013.01); *Y10S 292/47* (2013.01); *Y10T 292/65* (2015.04)

(58) Field of Classification Search
CPC ..... Y10T 292/65; Y10T 292/1051; Y10S 292/47; Y10S 292/20; E05C 17/60; E05B 65/0852
See application file for complete search history.

(56) References Cited

U.S. PATENT DOCUMENTS 804,994 A 11/1905 Andrews
976,777 A 11/1910 Brown
1,485,382 A 3/1924 Foley
4,824,154 A * 4/1989 Simpson ..... E05C 5/00 292/338
4,923,230 A 5/1990 Simpson
5,248,174 A 9/1993 Matz et al.
5,536,052 A 7/1996 Maier
5,575,116 A 11/1996 Carlson et al.
5,806,900 A * 9/1998 Bratcher ..... E05B 65/0864 292/137
6,364,375 B1 * 4/2002 Szapucki ..... E05B 65/0852 292/221
6,572,158 B2 6/2003 Szapucki et al.
7,431,356 B2 10/2008 Liang et al.
7,530,611 B2 5/2009 Liang et al.
7,588,271 B1 9/2009 Lawrence
7,600,796 B2 * 10/2009 Liang ..... E05C 17/50 292/207
7,637,544 B2 * 12/2009 Liang ..... E05C 17/50 292/338
8,182,001 B2 5/2012 Tremble et al.
8,235,430 B2 8/2012 Liang et al.
8,360,484 B2 1/2013 Liang et al.
8,776,442 B1 * 7/2014 Lawrence ..... E05B 9/08 49/449
8,806,809 B1 8/2014 Lawrence
8,833,809 B2 * 9/2014 Liang ..... E05B 15/04 292/219
9,435,149 B1 * 9/2016 Glickman ..... E05C 17/60
10,107,021 B1 * 10/2018 Liang ..... E05C 3/04
(Continued)

*Primary Examiner* — Justin B Rephann
(74) *Attorney, Agent, or Firm* — Tuggle Duggins P.A.; Blake P. Hurt

(57) ABSTRACT

A window vent stop is disclosed having a housing with a peripheral flange defining an opening, and a body depending from the peripheral flange. A stop block is mounted within the body of the housing for movement between an open position wherein a portion of the stop block protrudes above the peripheral flange and a closed position. A spring leg is located on a bottom end of the housing and flexes toward the housing when under compression, providing compressive force along a line parallel to a longitudinal axis of the housing when the window vent stop is inserted into an opening in a window sash. By applying force to further compress the spring leg, the vent stop can be readily removed from the window sash without damage.

11 Claims, 5 Drawing Sheets

(56) References Cited

U.S. PATENT DOCUMENTS

| | | | | |
|---|---|---|---|---|
| 2005/0011131 | A1* | 1/2005 | Liang | E05B 65/0852 49/449 |
| 2009/0206616 | A1 | 8/2009 | Liang et al. | |
| 2010/0281780 | A1 | 11/2010 | Liang et al. | |
| 2010/0300000 | A1* | 12/2010 | Liang | E05B 65/0829 49/449 |
| 2011/0113695 | A1 | 5/2011 | Derham | |
| 2012/0167475 | A1 | 7/2012 | Sopkowiak et al. | |

* cited by examiner

REMOVABLE WINDOW VENT STOP

FIELD OF THE INVENTION

The invention herein pertains to window hardware in general, and in particular to a window vent stop with one or more spring legs depending therefrom configured to engage a window wall surface under compression, so as to facilitate an easier entry and removal relative to the prior art.

DESCRIPTION OF THE PRIOR ART AND OBJECTIVES OF THE INVENTION

While windows come in a variety of shapes, sizes and types, two of the most common types of windows in use are known as hung windows and sliding windows. Both of these types of windows have at least one sash that slides relative to another sash as the window is opened or closed. With a double hung window, two sashes can move independent of one another in a vertical, up-down direction whereas with a double sliding window the sashes slide in a horizontal, side-to-side direction. The single hung and single slider window variations have only one moving sash while the other is fixed. There is often a need to open the window to allow fresh air to enter the building or for stale air to exit. A partially or fully open window, however, presents an easy access point to enter the premises and thus presents a security risk. In addition, a fully open window presents a safety risk for a child or small adult who might fall out of the window if the opening is large enough. Moreover, it is often desired to open a window, particularly the single hung and double hung window, at least partially even when raining outside and allow in fresh air, or vent stale air, while minimizing the amount of water entering the premises. Vent stops have been developed and used in the prior art to achieve these objectives.

Generally speaking, a vent stop is a device that is installed in the outermost window frame surface, for example within the window sash stile, rail or perhaps in the window frame jamb, on a surface against which the innermost sash slides. The vent stop may be recessed into the sash or jamb so as to be flush with the surface when not in use. When needed, the stop is manually activated to raise a portion of the stop above the surface of the sash, thus limiting the ability of the two sashes to slide against and/or passed one another.

Several prior art window stop devices have been proposed, including U.S. Pat. Nos. 5,575,116; 8,235,430; 8,360,484; and 8,806,809. The disclosures of these references are incorporated herein in their entirety by reference. These and other prior art window stops generally comprise a housing with a stop block mounted within the housing for movement between an extended position where a portion of the stop block extends beyond the housing and a retracted position wherein the stop block is contained mostly or completely within the housing.

In some prior art devices, a spring leg is located on at least one end of the housing and biases toward the housing as the stop is inserted into the opening in the sash, and then springs back to its original position to hold the housing in place. The spring legs in these devices are often configured to clamp the sash between the spring leg and a peripheral flange on the outside of the housing such that the forces used to secure the vent stop in place are directed transverse to the longitudinal axis of the housing.

While these prior art devices function to a degree, the mechanism for holding the housing in place has several disadvantages. For example, the design makes it practically impossible to remove the housing without damaging the stop device, the window sash, or both. Moreover, because the spring legs cooperate with the flange to clamp the sash material therebetween, the forces to secure the vent stop in place were directed against the thickness of the sash material. If that thickness is uneven or inconsistent at the opening for the vent sash (which happens frequently, for example such as the presence of burrs from the cutting operation, or inconsistency in the thickness of the vinyl or fiberglass), the clamping forces are negatively impacted. Finally, vent stops using this type of clamping force required tight tolerances in cutting the opening in the sash to ensure proper contact between the spring leg and the sash material. These tolerances are easily exceeded, for example during inclement weather, raising the possibility that the entire vent stop may be ejected from the window frame and permit the window to raise and/or lower inadvertently.

Accordingly, there is a need to for a window vent stop that has minimal moving parts and is simple to manufacture, assemble and operate and which can be readily removed and re-inserted into the sash without damage to the stop or the sash, and which does not rely on a harmful clamping force between a spring leg and the flange on the housing to secure the vent stop in place.

SUMMARY OF THE INVENTION

In accordance with a preferred embodiment, a window vent stop comprises a housing having a peripheral flange defining an opening and a body depending from the peripheral flange. A stop block is mounted within the body of the housing and is positioned within the opening in the flange. The stop block is movable between a first position wherein the stop block extends beyond the flange of the housing and a second position wherein the stop block is substantially flush with the flange. The housing is equipped with a spring leg at one end to provide for a snap lock type installation of the vent stop into a corresponding opening in the sash. One end of the spring leg is affixed to the housing, remote from the flange and the opposite end of the spring leg has a projection located proximate to the underside of the flange. Once inserted into an opening in the sash, the spring leg is under compression to bias the housing against the sash in a direction parallel to a longitudinal axis of the housing. By moving the housing toward the spring leg, the spring leg is further compressed to the point where the housing can be separated from the sash without damage to the sash or the window stop. Directing the biasing forces parallel to the longitudinal axis of the housing permits the vent stop can be secured in place even if the opening is not cut perfectly or the sash materials are of uneven or inconsistent thickness.

DETAILED DESCRIPTION OF THE PREFERRED EMBODIMENT AND OPERATION OF THE INVENTION

Figure 1:
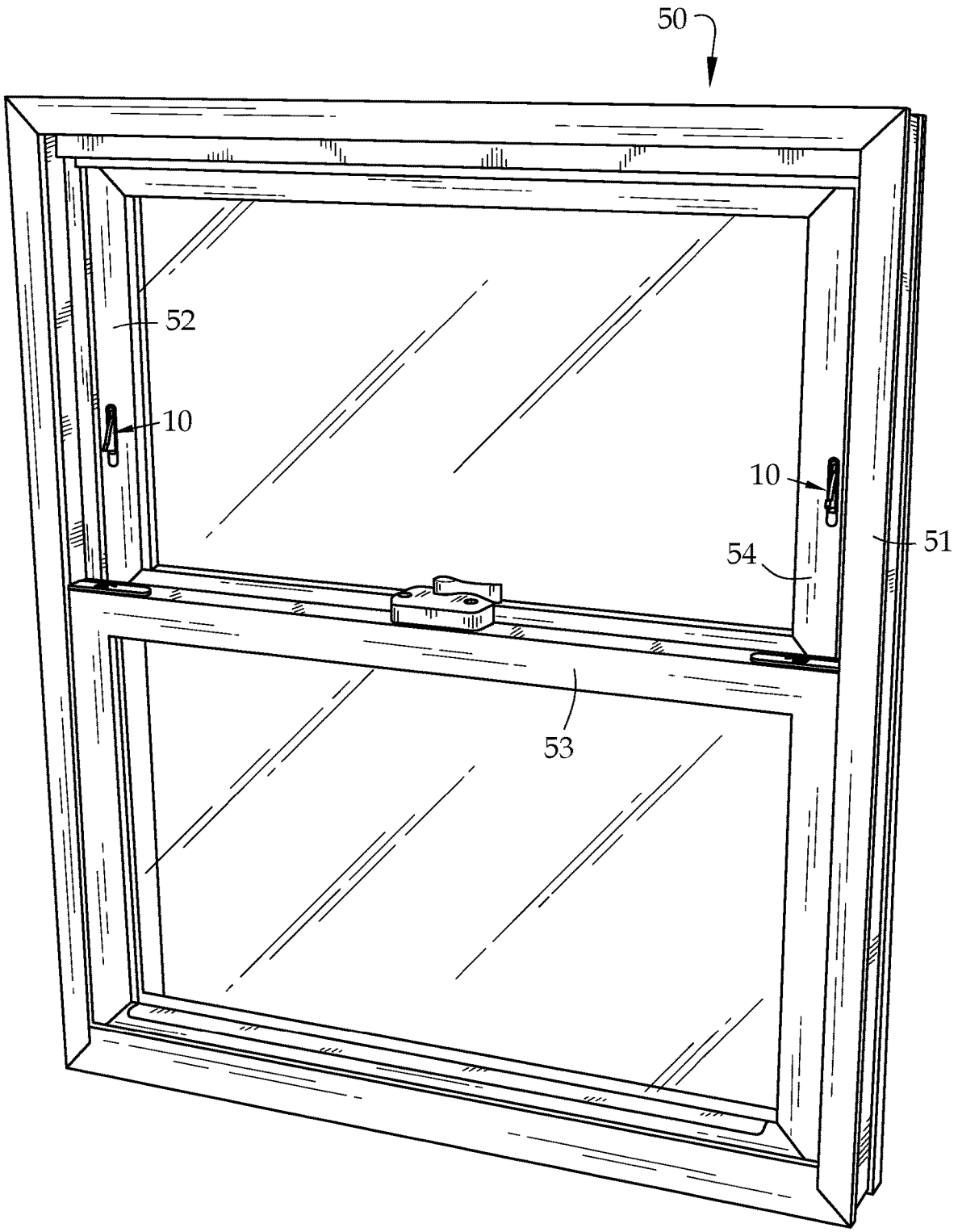
FIG. 1 is a perspective view of a typical single or double hung window unit showing the vent stops installed therein.

For a better understanding of the invention and its operation, turning now to the drawings, FIG. 1 illustrates a typical single or double hung window 50 having a frame 51, an upper sash 52 and a lower sash 53. In the view shown in FIG. 1, the lower sash 53 is the innermost sash because it is closest to the interior of the building and sash 52 is the outermost sash. A pair of vent stops 10, 10 are shown recessed into the inner face or stile 54 of upper sash 52. Inner face 54 is the face against which lower sash 53 slides as the lower sash 53 is raised or lowered (depending on the position of upper sash 52). As noted previously, this orientation and positioning is considered exemplary (and not intended as a limitation) as vent stops 10 may also be positioned at other locations about window 50 as desired, including (but not limited to) the jambs included within window 50 or positioned horizontally across the top rail of lower sash 53.

Figure 2:
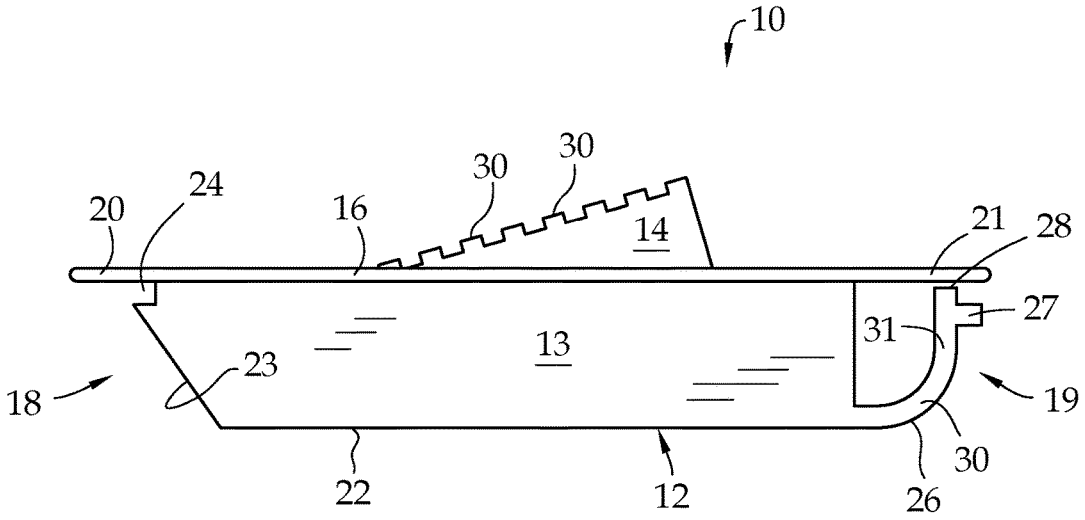
FIG. 2 is a side elevation view of a vent stop in accordance with a preferred embodiment of the invention, showing the stop block in the extended condition.
Figure 3:
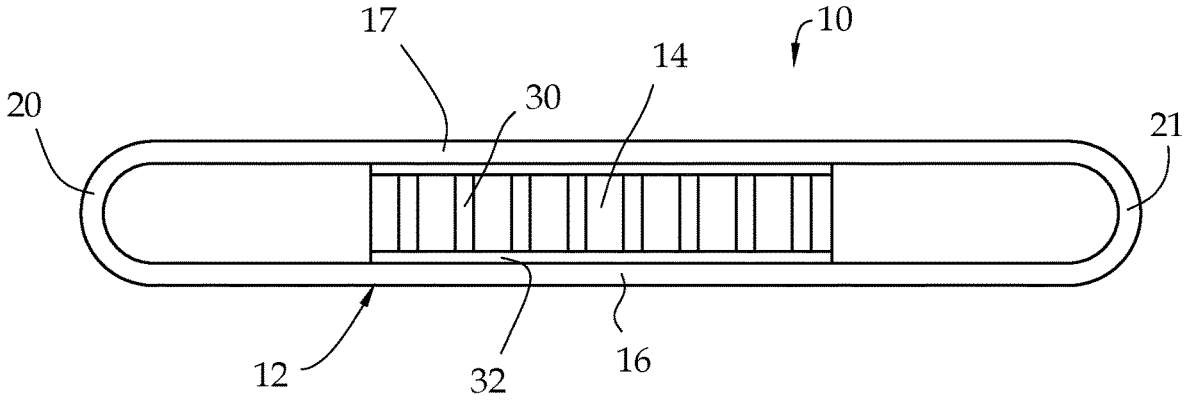
FIG. 3 is a plan view of a preferred embodiment of the window stop.

With reference to FIGS. 2 and 3, the vent stop 10 has a housing 12 and a stop block 14. Housing 12 comprises a box-like member having two lateral sides 13 (only one side 13 being shown in the referenced figures, it being understood that the opposing lateral side would be a mirror image of the same) and two longitudinal ends, 18, 19 with the longitudinal end 18 being referred to herein as the "top" end and longitudinal end 19 being referred to as the "bottom" end for convenience. The lateral sides 13 have an outwardly turned upper surface forming lateral flanges 16, 17. The top end 18 and bottom end 19 of the housing 12 each have semi-circular flange 20, 21 respectively. Flanges 16, 17, 20 and 21 together form a peripheral flange of the housing and define an opening 32 therein. While flanges 16, 17, 20, and 21 are described as separate components, nothing contained herein should be construed as preventing them from being integrally formed as a monolithic structure. The stop block 14 is positioned within the opening.

Figure 4:
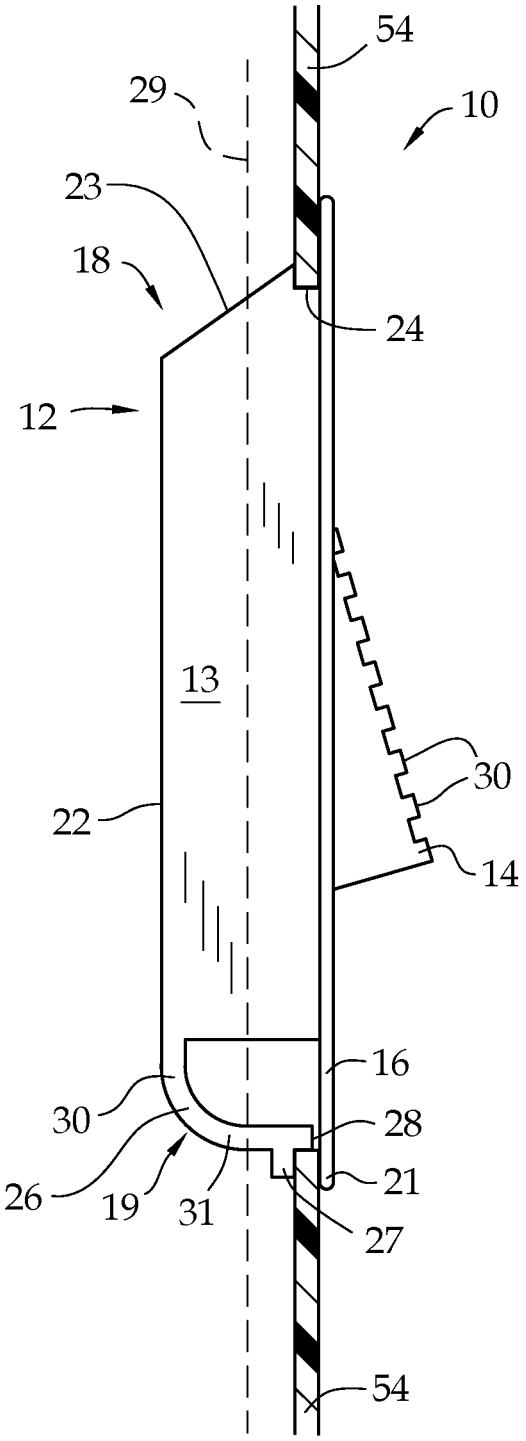
FIG. 4 is a side elevation view, partially sectioned, showing the window stop installed in a sash.
Figure 5:
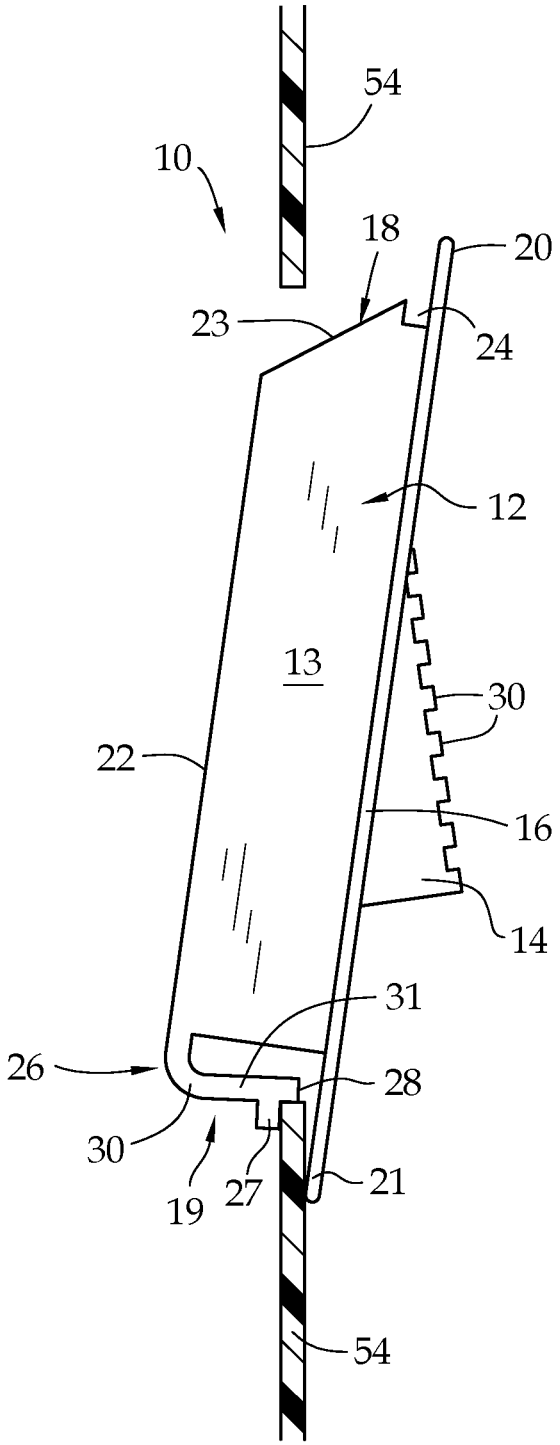
FIG. 5 is a side elevation view, partially sectioned, showing the window stop partially removed from the sash.

With reference to FIGS. 2-5, preferred top end 18 of housing 12 has an angular orientation and extends inwardly toward the back 22 of the housing 12, forming an inclined, ramp surface 23. The end of ramp surface 23 closest to the flange 20 may define a notch 24. The depth of notch 24 is determined based on the thickness of the material used to build the window sash and/or window frame, most often vinyl or fiberglass in current windows. As seen in FIG. 4 in particular, the window stop 10 is shown installed within a sash face 54 whereby the sash face 54 is received within the notch 24 and held therein against an underside surface of semi-circular flange 20.

With continued reference to FIGS. 2-5, the bottom end 19 of housing 12 has a preferred spring leg 26 that originates at the back 22 of housing 12 and extends outwardly and upwardly, terminating just below the underside surface of semi-circular flange 21. In one embodiment, this geometry may be generally considered a "U-shaped" configuration. The spring leg 26 preferably defines a curved or arched section 30 and a straight section 31, with the curved section 30 being attached to the housing 12. The curved section 30 of spring leg 26 functions as a pivot point, whereby the straight section 31 can flex toward and away from housing 12. The straight section 31 of spring leg 26 includes a protrusion 27 located near the distal end 28 of the spring leg 26. The distance between protrusion 27 and the underside of semi-circular flange 21 may be selected based on the typical thickness of the material used to build the sash.

As seen in FIG. 4 in particular, the window stop 10 is shown installed within a sash face 54 whereby the sash face 54 is received within the space between the protrusion 27 and the underside surface of semi-circular flange 21. Spring leg 26 is shown as being integrally formed with the housing 12. While this presents advantages in manufacture, it is not strictly necessary and other constructions may be used if desired. The vent stop 10 can easily be installed into a suitably sized and shaped opening in the widow sash. Unlike prior art window stops, the vent stop 10 can also be readily removed from the sash without damaging the sash or the vent stop. Particular reference is made to FIGS. 4 and 5 for the discussion below on how the vent stop 10 is installed or removed from the sash.

To install the vent stop 10, the bottom end 19 is inserted first by positioning the edge of the opening in the sash face 54 within the space between the projection 27 on spring leg 26 and the underside of semi-circular flange 21 to sandwich the sash face 54 between the projection 27 and the flange. The top end 18 of the housing 12 would then be pivoted toward the sash face 54, with ramp surface 23 forcing the housing 12 to compress spring leg 26 until the edge of the opening in the panel fits within the notch 24 at the top end 18 of housing 12. When the vent stop 10 is fully installed, the compressive forces in the spring leg 26 press the top end 18 of housing 12 against the edge of the opening in the sash face 54. Thus, the vent stop is maintained within the opening in the panel by compressive forces that are oriented along the longitudinal axis of the housing 12, as indicated by dotted line 29 in FIG. 4. This differs from prior art devices in which the vent stop is held by clamping forces exerted between a spring leg and the underside of the flange; i.e., forces in a direction transverse to the longitudinal axis of the housing. The notch 24 and projection 27 serve primarily to prevent pull out of the vent stop from the sash and contribute little or no compressive forces.

The vent stop 10 can be removed from the sash by essentially reversing the process described above. First, the vent stop 10 will be pushed downwardly toward the bottom end 19 of the housing 12. Raising the stop block 14 and using it as a grip point will facilitate this step. Spring leg 26 will compress against the downward movement of the housing 12, allowing the vent stop to move downward relative to the sash face 54. Once the edge of the opening in the sash face 54 is clear of the ramped surface 23 of top end 18, the top end 18 of vent stop 10 can be pivoted away from the panel and the vent stop 10 can be readily removed.

Apart from the ability to be removed from the sash without damage, the vent stop of the invention is also more forgiving with imperfectly formed openings in the sash and variations in thickness of the sash material (i.e., vinyl or fiberglass). As noted above, the vent stop of the invention is held in place by the compressive force of the spring leg asserting forces against the edges of the opening in the sash, rather than by clamping or pinching the sash material between a spring leg and the flange. Accordingly, the vent stop of the invention will be held in place so long as the spring leg is under some compression when the vent stop is installed.

Figure 6:
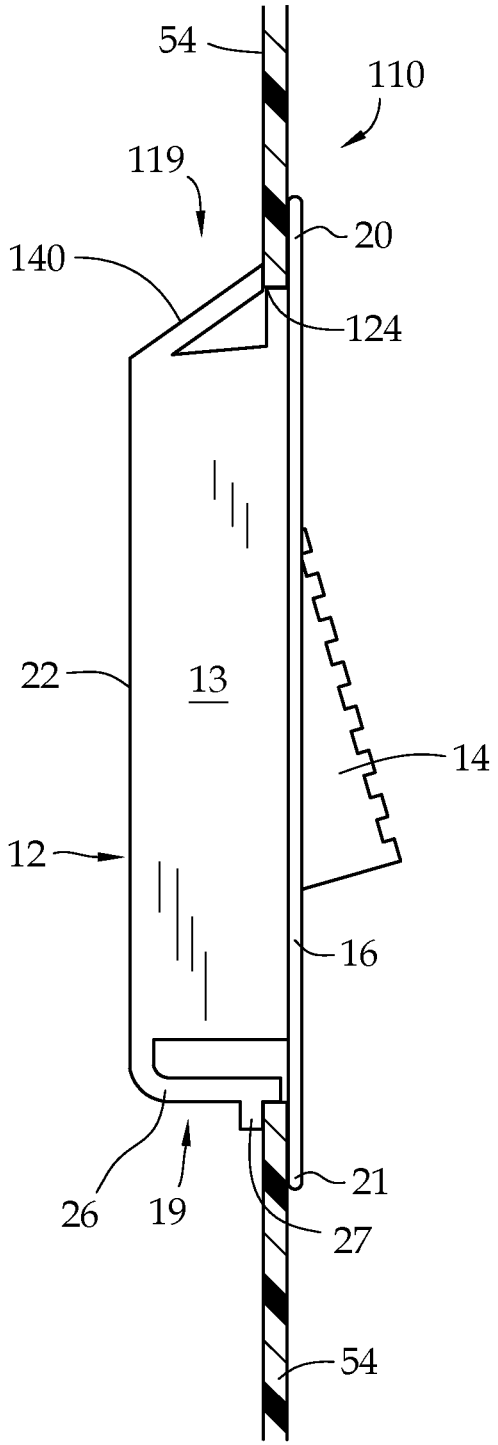
FIG. 6 is a side elevation view, partially sectioned, of an alternate embodiment of the vent stop shown installed in a window sash.

With reference to FIG. 6, an alternate embodiment of the vent stop is shown. In the embodiment of FIG. 6, vent stop 110 may be in all respects the same as vent stop 10, except with respect to the top end 119 of housing 12. In this embodiment, the ramp surface of top end 119 is formed by a spring leg 140. Spring leg 140 is affixed adjacent to the back 22 of housing 12 and extends upwardly and outwardly toward the flange 20. The spring leg 140 terminates just short of the underside of the flange 20, thus forming a recess 124 to receive the sash face 54 therein.

The housing may be of single piece or multi-piece construction, as is known in the art. Similarly, the prior art has disclosed numerous types of stop blocks and the mechanisms for their operation. Any of these known constructions may be used to advantage in the present invention. In preferred embodiments, the stop block has a series of ridges 30 on an upper surface thereof.

The illustrations and examples provided herein are for explanatory purposes and are not intended to limit the scope of the appended claims. Changes in the shapes and materials employed herein are anticipated by those skilled in the art as different plastics, sizes and configurations may be used as available without departing from the inventive concept divulged.

I claim:

1. A window vent stop comprising a housing including a peripheral flange defining an opening, and a body depending from the peripheral flange; a stop block mounted within the body of the housing for movement between an open position wherein a portion of the stop block protrudes above the peripheral flange and a closed position; a flexible spring leg on a first end of the housing defining a projection located proximate a distal end of the spring leg and spaced from the distal end by a pre-determined distance, the spring leg configured to provide compressive force along a line parallel to a longitudinal axis of the housing when the window vent stop is inserted into an opening in a window sash, and is configured to provide flexion along the line parallel to the longitudinal axis of the housing, but in the opposite direction relative to when the window vent stop is inserted into the opening in the window, thereby facilitating the removal of the window vent stop; and a second end opposite the first end of the housing, the second end defining an angular orientation and extending inwardly toward a back of the housing, forming a ramp surface with a notch adjacent the peripheral flange, the notch spaced from the ramp surface by a pre-determined distance.

2. The window vent stop of claim 1, wherein the peripheral flange comprises straight lateral sides and semi-circular ends.

3. The window vent stop of claim 1, wherein the stop block has a top surface with a series of ridges.

4. The window vent stop of claim 1, wherein the spring leg comprises an arched section and a straight section.

5. The window vent stop of claim 1, wherein the spring leg comprises an arched section and a straight section, wherein the arched section is proximate the housing.

6. The window vent stop of claim 1, wherein the spring leg comprises an arched section and a straight section, wherein the projection is affixed in perpendicular orientation to the straight section.

7. The window vent stop of claim 1, wherein the spring leg comprises an arched section and a straight section, wherein the arched section is proximate the housing and wherein the projection is affixed in perpendicular orientation to the straight section.

8. The window vent stop of claim 1, wherein the spring leg is configured to be partially compressed when the vent stop is installed in a window sash.

9. The window vent stop of claim 1, wherein the spring leg further comprises an arched section and a straight section, the straight section attached via the arched section at a back of the housing and projecting upward and outwardly toward the peripheral flange, the straight section terminating short of the peripheral flange to form a gap between the spring leg and the peripheral flange.

10. The window vent stop of claim 1, wherein the spring leg further comprises an arched section and a straight section, the straight section attached via the arched section at a back of the housing and projecting upward and outwardly toward the peripheral flange, the straight section terminating short of the peripheral flange to form a gap between the spring leg and the peripheral flange; and wherein the spring leg on the first end comprises an arched section and a straight section, wherein the arched section is proximate the housing and wherein the projection is affixed in perpendicular orientation to the straight section.

11. A window vent stop consisting of a housing including a peripheral flange defining an opening, and a body depending from the peripheral flange; a stop block mounted within the body of the housing for movement between an open position wherein a portion of the stop block protrudes above the peripheral flange and a closed position; a flexible spring leg on a first end of the housing defining a projection oriented perpendicular to a straight spring leg portion and located proximate a distal end of the spring leg and spaced from the distal end by a pre-determined distance, the spring leg configured to provide compressive force along a line parallel to a longitudinal axis of the housing when the window vent stop is inserted into an opening in a window sash, and is configured to provide flexion along the line parallel to the longitudinal axis of the housing, but in the opposite direction relative to when the window vent stop is inserted into the opening in the window, thereby facilitating the removal of the window vent stop; and a second end opposite the first end of the housing, the second end defining an angular orientation and extending inwardly toward a back of the housing, forming a ramp surface with a notch adjacent the peripheral flange, the notch spaced from the ramp surface by a pre-determined distance.

* * * * *